US009815661B1

(12) United States Patent
Brockmueller et al.

(10) Patent No.: US 9,815,661 B1
(45) Date of Patent: Nov. 14, 2017

(54) RE-USABLE TUBE FOR WINDING FIBERGLASS YARN

(71) Applicants: Hulsen, Inc., Advance, NC (US); Precision Belting, Inc., Rock Hill, SC (US)

(72) Inventors: Bernd Brockmueller, Advance, NC (US); Kenneth Scott Bozeman, Rock Hill, SC (US)

(73) Assignees: Hulsen, Inc., Advance, NC (US); Precision Belting, Inc., Rock Hill, SC (US)

( * ) Notice: Subject to any disclaimer, the term of this patent is extended or adjusted under 35 U.S.C. 154(b) by 0 days.

(21) Appl. No.: 15/082,370

(22) Filed: Mar. 28, 2016

(51) Int. Cl.
*B65H 75/10* (2006.01)
*B65H 75/24* (2006.01)

(52) U.S. Cl.
CPC ..... *B65H 75/10* (2013.01); *B65H 75/24* (2013.01); *B65H 2701/514* (2013.01); *B65H 2701/5112* (2013.01); *B65H 2701/5118* (2013.01)

(58) Field of Classification Search
CPC B65H 75/10; B65H 75/24; B65H 2701/5112; B65H 2701/5118; B65H 2701/514
See application file for complete search history.

(56) References Cited

U.S. PATENT DOCUMENTS

| | | | | |
|---|---|---|---|---|
| 3,756,530 | A * | 9/1973 | Ito | B65H 75/24 242/118.11 |
| 3,910,513 | A | 10/1975 | Gelin et al. | 242/18 |
| 6,719,242 | B2 | 4/2004 | Floyd, Jr. et al. | 242/609.4 |
| 7,332,203 | B2 | 2/2008 | Hernandez | 428/34.2 |

OTHER PUBLICATIONS

Polystrand Technical Data sheet.

* cited by examiner

*Primary Examiner* — William E Dondero
(74) *Attorney, Agent, or Firm* — MacCord Mason PLLC

(57) ABSTRACT

A winding tube for glass fiber yarn has an inner cylinder and an outer polyester fabric covering. The inner cylinder is made of a composite having at least two sheets of polypropylene film bonded together, with each sheet having a plurality of parallel fiberglass filaments embedded within the film of that sheet, and with the filaments of one sheet being at an angle with the filaments of the other sheet. The fabric has a spiral stitching. The tube maintains a cylindrical shape when not subject to deforming forces yet has sufficient flexibility that after a desired amount of glass fiber yarn is wound on the winding tube, the winding tube can be radially collapsed sufficiently to permit the winding tube to be withdrawn from within the yarn package. The winding tube is dimensionally stable at the elevated temperatures to which is likely to be exposed.

18 Claims, 6 Drawing Sheets

RE-USABLE TUBE FOR WINDING FIBERGLASS YARN

BACKGROUND OF THE INVENTION

This application relates to a new re-usable tube for winding fiberglass yarn, particularly in the initial yarn formation stage. That yarn formation process is described in U.S. Pat. No. 3,910,513 to Gelin, et al. and those of ordinary skill in the art are familiar with the process described therein. Gelin discloses that the yarn (also referred to as a roving at this stage) starts out as molten glass. It is drawn through bushings into fine strands that are then cooled by water and wound on a tube mounted on a collet. Once the package of yarn on the tube has been completely wound on a collet, the tube can be removed from the collet and is internally collapsible to a reduced diameter so it can be withdrawn from the core of the package, leaving only the package or "cheese" of fiberglass yarn or roving. These packages typically weight about 45 pounds and during the winding process can rotate as fast as 4500 rpm. These conditions put stresses on the tube the yarn is wound on and require reliable tube performance. In many cases the package is further treated after the package is complete and before the tube is removed.

U.S. Pat. No. 6,719,242 to Floyd et al. describes subsequent processing of the newly-formed yarn to drive off aqueous or other solvents from a finish applied to the yarn. This heat treating is described by Floyd et al. as including exposing the yarn on its winding tube to temperatures as high as 400 degrees Fahrenheit. In practice, however, temperatures more typically top out at 300-310 degrees Fahrenheit. Nonetheless, such temperatures are extreme enough to cause gradual degradation of the tube as it undergoes numerous reuses. The disclosures of the Gelin et al. and Floyd et al. patents are incorporated herein by reference.

The conventional tubes, which are commonly made of layers of paper, fail prematurely, requiring their replacement. Some tubes incorporate Tyvek fabrics of man-made fibers and filaments suitable for making into household furnishings and apparel and for industrial uses. Various attempts have been made to improve the longevity of the tubes, but often encounter other drawbacks, particularly arising from the differential thermal expansion of the layers of the tube that put stresses on the tube to make the tube fail early or otherwise fail as successful tubes for holding the yarn in place to make a the cheese or package that producers desire.

SUMMARY OF THE INVENTION

The present invention fulfills one or more of these needs in the art by providing a winding tube for glass fiber yarn. The tube has an inner cylinder and an outer covering on the inner cylinder. The inner cylinder is made of a composite having at least two sheets of thermoplastic film bonded together. Each sheet has a plurality of parallel filaments embedded within the film of that sheet, and the filaments of one sheet are non-parallel with the filaments of the other sheet. The outer covering is a fabric to which glass fiber yarn can be wound to make a yarn package. The resulting winding tube has sufficient resilience to maintain a cylindrical shape and sufficient flexibility that after a desired amount of glass fiber yarn is wound on the winding tube to make a yarn package, the winding tube can be radially collapsed sufficiently to permit the winding tube to be withdrawn from within the yarn package.

In a preferred embodiment the thermoplastic film is polypropylene. The fabric may be polyester. Typically, the fabric has a spiral stitching of thread. The spiral stitching of thread has a spiral pitch so that courses of the thread in the spiral are spaced from 0.5 inch to 2 inches apart. The stitching bonds the fabric to the inner cylinder in some embodiments.

The winding tube is generally cylindrical and has a length and a circumference. The composite is generally rectangular and has a length equal to the length of the winding tube and a width slightly less than the circumference of the winding tube. These dimensions result in a gap between ends of the composite in the assembled winding tube, so the two ends of the composite can deflect inwardly as the winding tube is radially collapsed without having either end of the composite block the other's radially inward movement. In this embodiment the fabric can be bound, such as by the stitching, to the composite substantially completely around the circumference of the cylinder.

In another embodiment, the outer cover is not bound to the composite adjacent the gap so one end of the composite can deflect inwardly past the other end as the winding tube is radially collapsing without having the ends of the composite block each other's radially inward movement. In another embodiment blocking can be avoided by making one end overlap inside the other.

In a preferred embodiment the winding tube is dimensionally stable in length and width at a thermal expansion of 0.000015 inches/inch/degree Fahrenheit or less.

The winding tube is generally cylindrical and typically has a diameter of from six to fourteen inches.

The composite may be made of sheets are made with long fiber technology in which the filaments are selected from the group consisting of fiberglass, Kevlar man-made fibers for generalized use in the industrial arts, Nomex man-made fibers and sheet structures for general use in the industrial arts, and for various military applications, carbon fiber, and Spectra polyethylene fiber. Preferably, the filaments are fiberglass.

Typically, the filaments of one sheet are oriented at 90 degrees with the filaments of the other sheet.

The composite may have a memory of being flat and the outer covering fabric is typically flexible. As a result the composite and outer covering fabric cooperate to form a cylindrical shape that is held open by the resilience of the composite seeking to restore is flat shape, constrained by the outer fabric in the form of a sheath or sleeve.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

As noted above, the invention relates to a winding tube for fiberglass.

Figure 1:
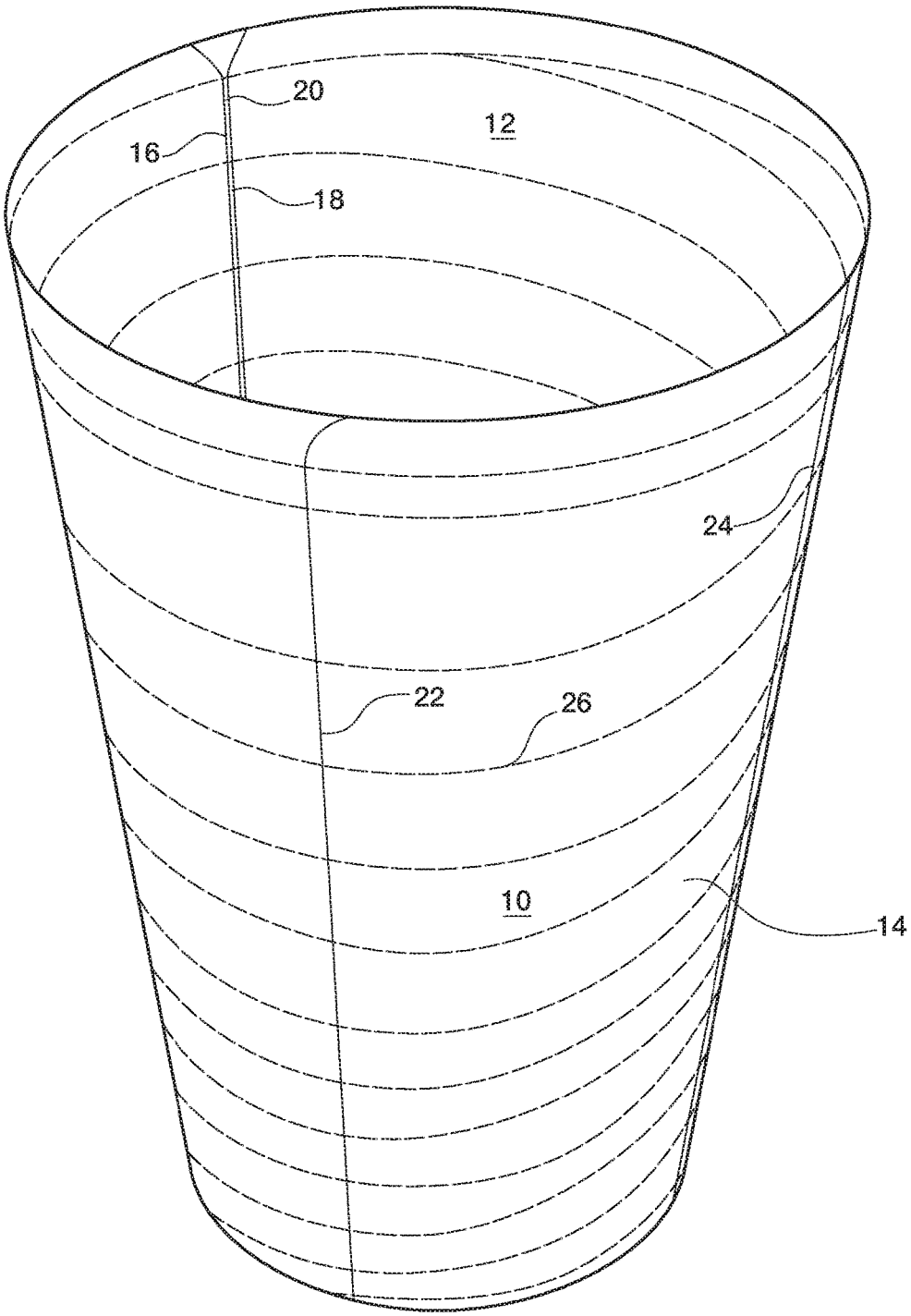
FIG. 1 is an end perspective view an embodiment of a tube made in accordance with the invention.

FIG. 1 shows an example of the tube 10 that has an inner cylinder 12 and an outer covering 14 on the inner cylinder. The outer covering 14 is typically fabric and acts as a sheath on the inner cylinder. The inner cylinder is made of a composite having at least two sheets of thermoplastic film bonded together with each sheet having a plurality of parallel filaments embedded within the film of that sheet, but the filaments of one sheet are not parallel with the filaments of the other sheet. The sheets of film can be bonded by thermal bonding or other suitable bonding method. The composite making up the inner cylinder 12 is typically a rectangle and has two ends 16 and 18 that approach but do not meet in the formation of the cylinder, leaving a gap 20. That is, the sheet is a rectangle that has a width that is about the length of the winding tube and a length that is slightly shorter than the circumference of the tube. The sheet is held to that curved configuration by the surrounding fabric that is wrapped with its two ends 22 and 24 extending past each other and generally not at the same circumferential position as the gap 20. The fabric and composite are stitched together with a spiral stitching 26 in the embodiment of FIG. 1.

Figure 6:
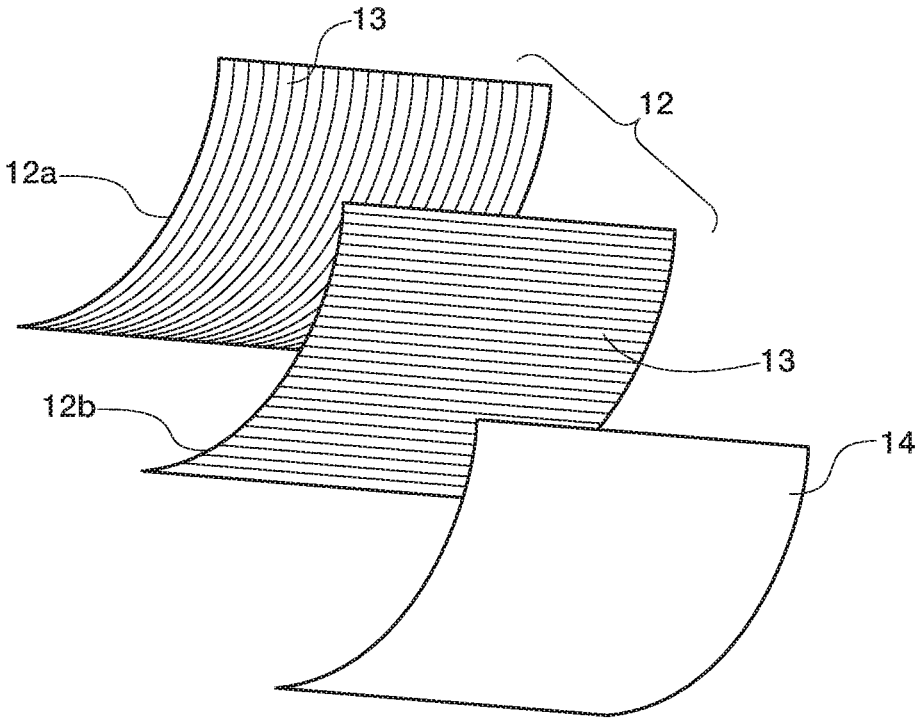
FIG. 6 is an exploded schematic view showing layers included in the winding tube.

The inner composite layer 12 is preferably made of sheets made of fiberglass and thermoplastic as a fiber reinforced thermoplastic (FRP). The preferred thermoplastic is polypropylene, but other thermoplastics may be used as suitable. As seen in FIG. 6 in schematic form, the composite 12 is made up of two sheets or layers 12*a* and 12*b*, each with an embedded array of reinforcing filaments 13. The filaments in each layer are generally parallel with the other filaments in that layer and add strength and thermal dimensional stability to the sheet of the layer in which they are embedded. The filaments of one layer are not parallel with the filaments of the other layer. Typically, the filaments of one layer are at right angles to the filaments of the other layer, but other angular orientations can be used, such as 30 degrees or 45 degrees. For right angled layers, typically, one set of filaments is parallel with the axis of the tube with the other set of filaments being circumferential around the tube, but other orientations can be used. The composite typically has a "memory" of being flat but has flexibility, so it can be curved as described above, but will exert a restoring force toward flatness, to be restrained by the fabric sheath, so the two elements to cooperate to make the cylindrical shape. A suitable composite is available from is Polystrand (http://www.polystrand.com).

Alternative filaments for the composite using long fiber technology are selected from the group consisting of fiberglass, Kevlar man-made fibers for generalized use in the industrial arts, Nomex man-made fibers and sheet structures for general use in the industrial arts, and for various military applications, carbon fiber, and Spectra polyethylene fiber.

The fabric sheath 14 can be a conventionally used polyester construction. The preferred thread that is stitched into the fabric for stitching 26 is polyester and nylon, and can be various sizes, depending on availability and/or tube construction. The yarn is stitched to at least the fabric sheath in a spiral pitch with courses spaced at about 1.5 inches. Other spacings can be used, such as others within the range of 0.5 to 2 inches. The stitches are formed with a stitch length of 2-5 mm. The stitching adds strength to the tube to act against outward bowing at the high centrifugal forces to which the tube will be exposed. Also, the stitches minimize sliding of the fiberglass yarn on the surface of the tube.

Figure 2:
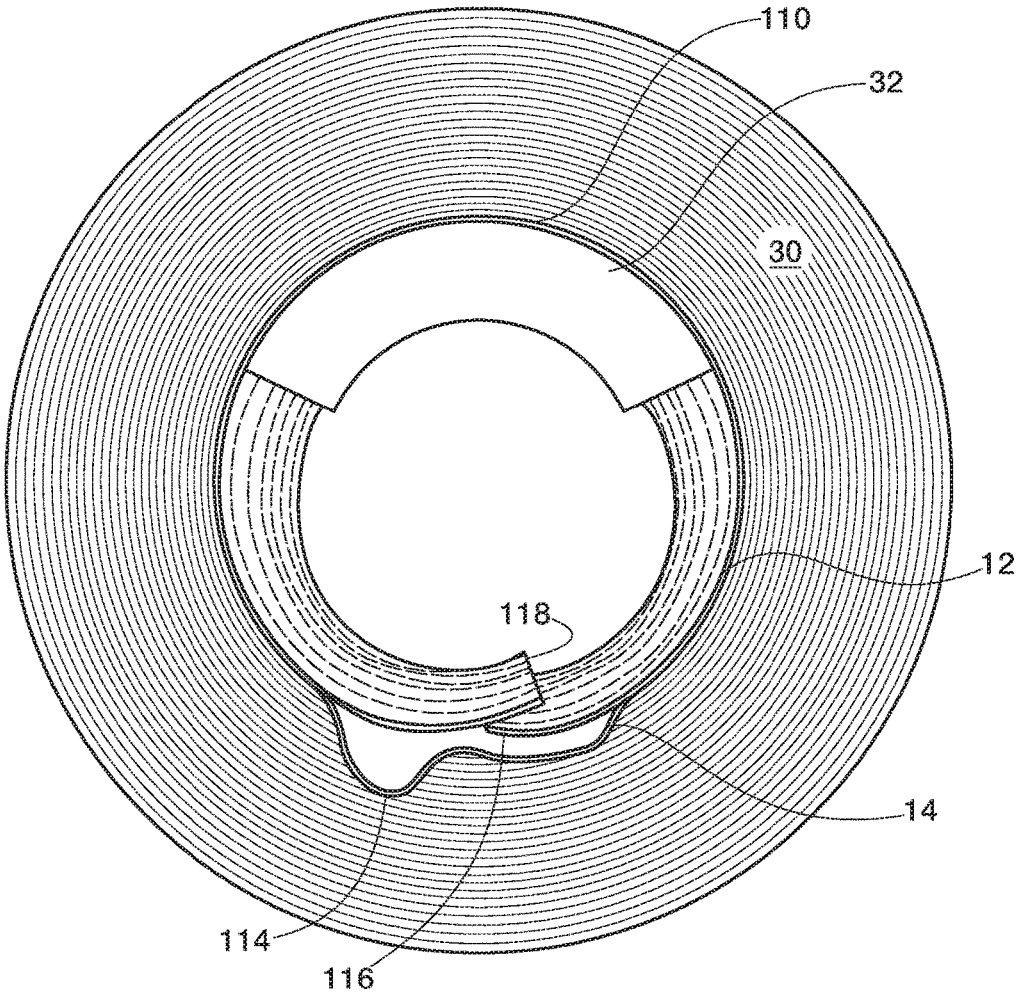
FIG. 2 is an end view of a tube made in accordance with the invention with a cheese or package of fiberglass windings and as supported by a protrusion from a cart commonly used in fiberglass yarn production facilities.
Figure 3:
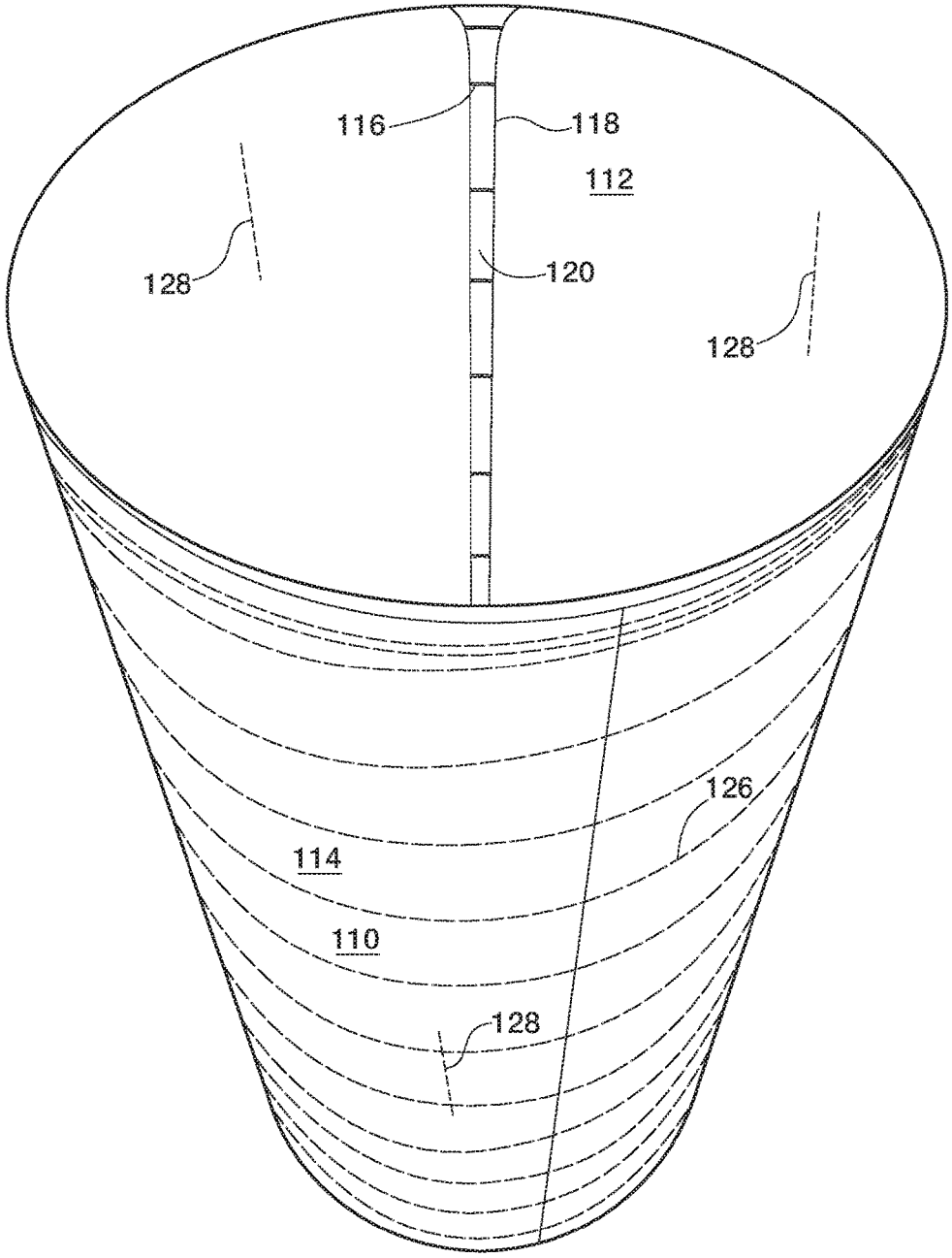
FIG. 3 is an end perspective view another embodiment of a tube made in accordance with the invention.

FIG. 3 shows a perspective view of an alternate embodiment. Tube 110 has an inner cylinder 112 and an outer covering 114 on the inner cylinder. The inner cylinder 112 and outer covering 114 are made of the same materials as the embodiment of FIG. 1. The inner cylinder 112 has two ends 116 and 118 that approach, but do not meet, in the formation of the cylinder, leaving a gap 120. The sheet is held to that curved configuration by the surrounding fabric covering 114, as before. The fabric makes up a surrounding sheath and the spiral stitching in this embodiment is only in the fabric covering 114, not the composite making up the inner cylinder 112. Three additional joining stitchings 128 are provided to join the fabric to the composite sufficiently to retain the overall cylindrical configuration. In this embodiment, therefore, the ends 116 and 118 are not stitched to the fabric, so they can readily flex inwardly, as can be seen in FIG. 2.

FIG. 2 shows the tube 110 mounted on a curved protrusion 32 of a cart commonly used in a fiberglass yarn making facility. The tube 110 has a cheese or package of yarn 30 wound on it. At this stage, the processing of the yarn is complete, and the tube 110 can be removed from the interior of the yarn package. In fact, as shown, the support of the cheese by the protrusion 32 permits the relaxation of the tube, with the end 118 of the composite passing inward of the end 116, and the wrinkling of the fabric 114. At this stage, further inward collapsing of the tube can be readily performed by hand or by robot, leaving the core-less cheese of yarn available for palletizing or further processing. When the tube 110 is removed from within the cheese, it returns toward its cylindrical shape, and that cylindrical shape is reinforced when the tube is placed on and surrounds a cylindrical collet for the next round of use.

Figure 4:
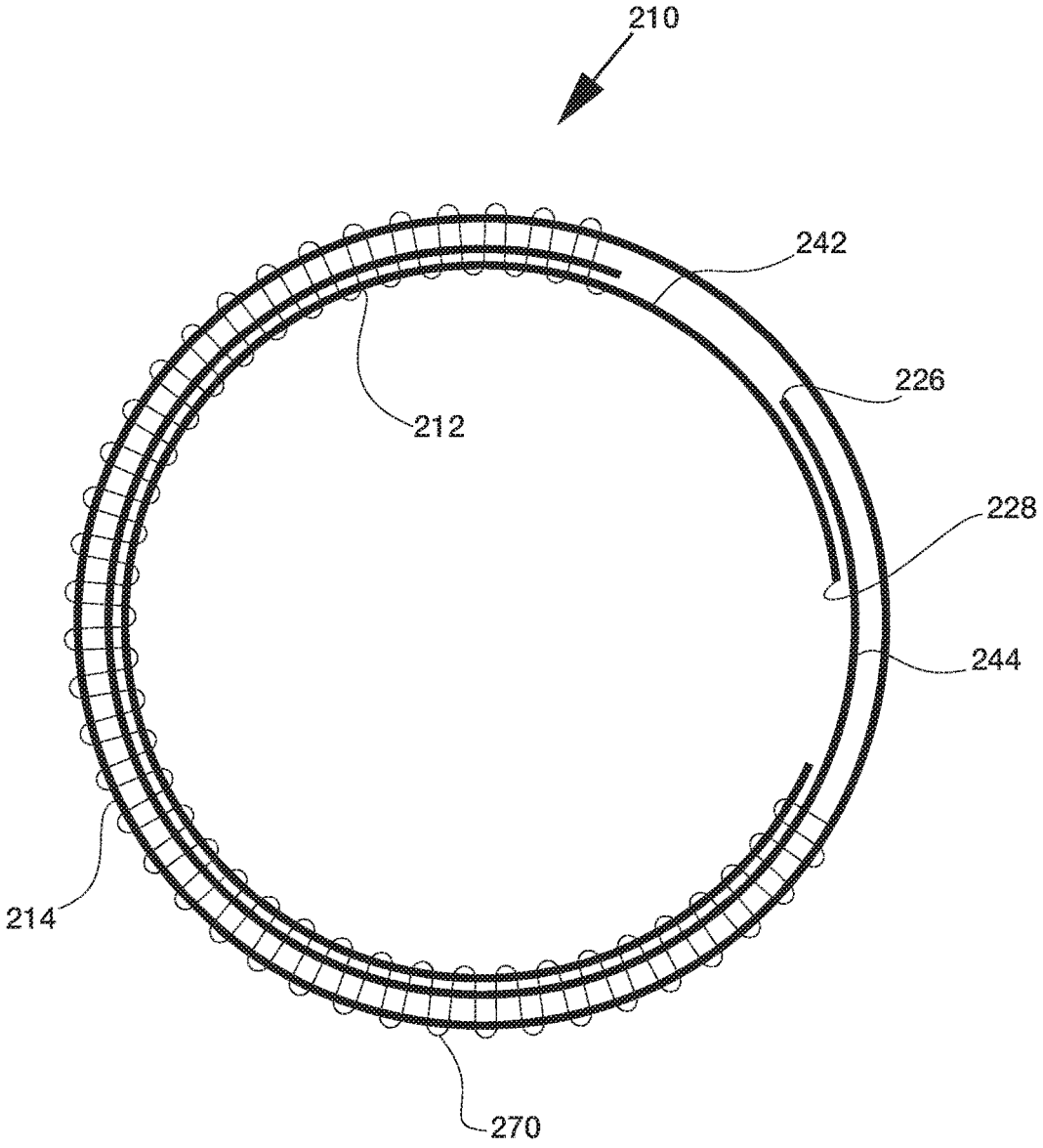
FIG. 4 is a schematic end view another embodiment of a tube made in accordance with the invention.

FIG. 4 is an end schematic view of another tube configuration. The tube 210 is again made with an inner composite and an outer fabric sheath 214, as above. In this case, the composite sheet is made up of two joined composites 242 and 244 that together are slightly longer than the circumference of the tube, so the end 228 passes to the inside an outer wrap of the composite and end 226 passes to the outside. That is, the composite is made so its ends overlap. Each composite 242, 244 extends for roughly 330 degrees around the circumference, but they are offset from each other to establish the overall circular form. Stitching 270 holds the two composites together, leaving the overlapping edges 226 and 228 unstitched. This configuration allows the end 228 to move inward without colliding with the end 226, and the end 226 can by moved inwardly, sliding over the surface of the composite.

Preferred tubes can withstand rotation on a twelve inch collet during winding of up to 4,500 rpm and continued exposure to temperatures up to 310 deg. F. The tubes can be made in the sizes needed for fiberglass yarn production facilities, which typically are metric sizes corresponding to 6, 8, 9 or 12 inch tube diameters. Other diameters, including a range of 6-14 inches can be used. The resulting tubes retain their usefulness for longer lives (more uses) than conventional tubes. They are more workable with robots in yarn production facilities.

Another variant of the invention can include tubes with a line of stitching to bind the two fabric ends together to the inner cylinder. This line of stitching can assist in holding the tube shape together as later spiral stitching is added.

In another embodiment, particularly using the tube shown in FIG. 3, after a period of use, the stitching 128 can be removed so the fabric is no longer bound to the composite inner cylinder, allowing them to be separated. A replacement fabric sleeve can be slipped over the composite and re-stitched.

Figure 5:
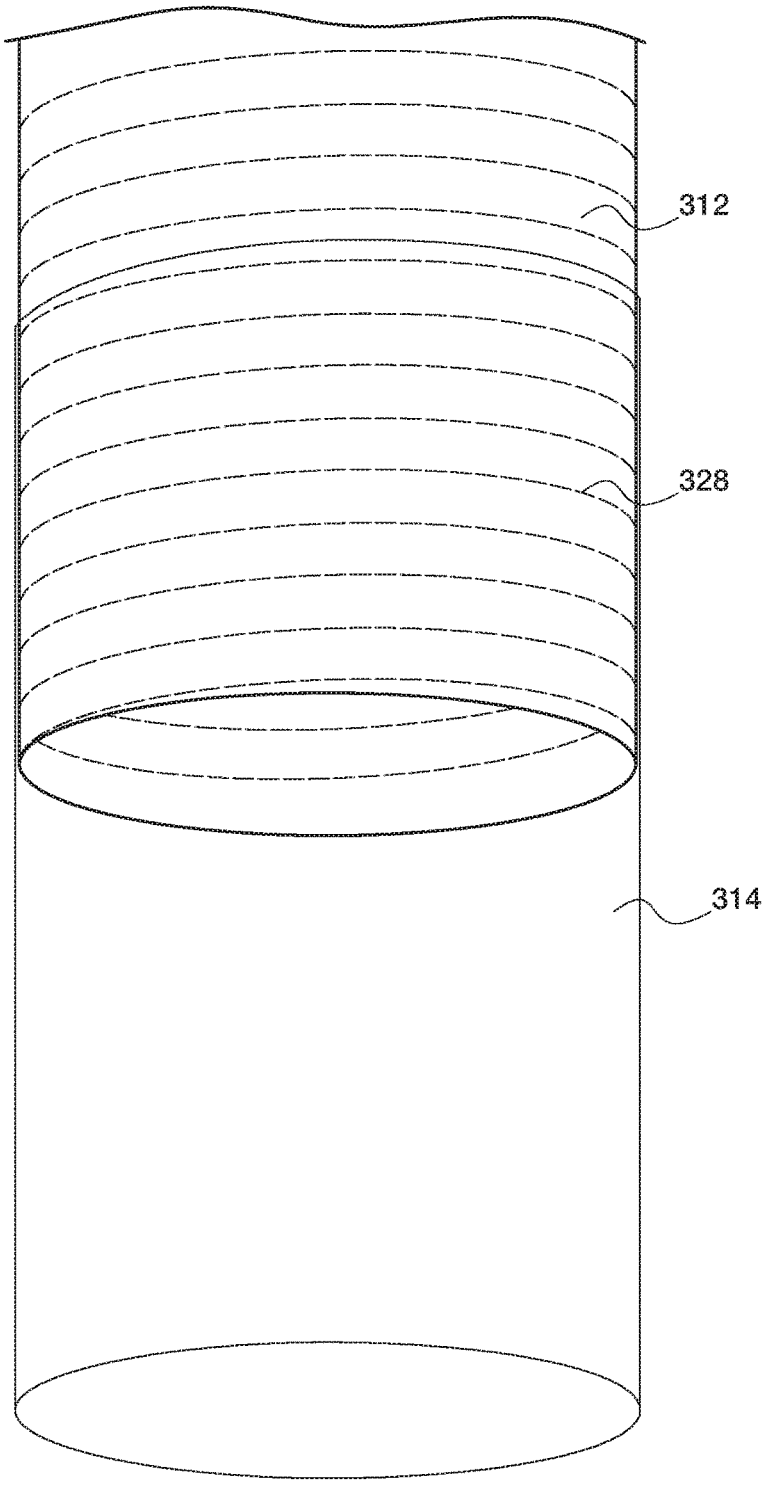
FIG. 5 is a perspective view of another embodiment of a tube made in accordance with the invention.

In a further embodiment seen in FIG. 5, the sleeve can be a plastic sleeve 314 of a film such as vinyl, polypropylene or other suitable plastic, rather than fabric. The plastic sleeve film slips over the composite inner cylinder 312 and remains unbound to the cylinder, held in place by friction. The cylinder 312 can have the spiral stitching 328. Once a cheese of yarn has been wound on the tube, the inner cylinder can be collapsed as before for removal, leaving the sleeve stuck to the fiberglass yarn windings, due to the adhesive properties of the yarn and/or its finish. But, due to the flexibility of the sleeve, the sleeve can be quickly pulled loose inward of the cheese for removal. It can then be re-placed on a composite inner cylinder for the next yarn-winding event. Over a number of winding iterations, the finish from the yarn builds up on the sleeve to the point it is no long usable, and the sleeve can be discarded and replaced with a fresh sleeve.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. A winding tube for glass fiber yarn comprising an inner cylinder and an outer covering on the inner cylinder, the inner cylinder being made of a composite having at least two sheets of thermoplastic film bonded together with each sheet having a plurality of parallel filaments embedded within the film of that sheet, and with the filaments of one sheet being non-parallel with the filaments of the other sheet, the outer covering being a fabric or sleeve to which glass fiber yarn can be wound to make a yarn package, the winding tube having sufficient resilience to maintain a cylindrical shape and sufficient flexibility that after a desired amount of glass fiber yarn is wound on the winding tube to make a yarn package, the winding tube can be radially collapsed sufficiently to permit the winding tube to be withdrawn from within the yarn package.

2. An apparatus as claimed in claim 1 wherein the thermoplastic film is polypropylene.

3. An apparatus as claimed in claim 1 wherein the fabric is polyester.

4. An apparatus as claimed in claim 1 wherein the fabric has a spiral, radial or longitundinal stitching of thread.

5. An apparatus as claimed in claim 4 wherein the stitching of thread is spiral having a pitch so that courses of the thread in the spiral are spaced from 0.5 inch to 2 inches apart.

6. An apparatus as claimed in claim 1 wherein the winding tube is generally cylindrical and has a length and a circumference, the composite is generally rectangular and has a length equal to the length of the winding tube and a width slightly less than the circumference of the winding tube, resulting in a gap between ends of the composite in the assembled winding tube, so the two ends of the composite can deflect inwardly as the winding tube is radially collapsed without having the ends of the composite block each other's radially inward movement.

7. An apparatus as claimed in claim 6 wherein the winding tube is dimensionally stable with a thermal expansion of 0.000015 inches/inch/degree Fahrenheit of or less.

8. An apparatus as claimed in claim 1 wherein the winding tube is generally cylindrical and has a length and a circumference, the composite is generally rectangular and has a length equal to the length of the winding tube and a width less than the circumference of the winding tube, resulting in a gap between ends of the composite in the assembled winding tube, the outer cover not being bound to the composite adjacent the gap so one end of the composite can deflect inwardly past the other end as the winding tube is radially collapsed without having the ends of the composite block each other's radially inward movement.

9. An apparatus as claimed in claim 1 wherein the winding tube is generally cylindrical and has a length and a circumference, the composite is generally rectangular and has a length equal to the length of the winding tube and a width greater than the circumference of the winding tube so that an end of the composite extends past the other end of the composite forming an overlap, the outer cover not being bound to the composite adjacent the overlap so one end of the composite can deflect inwardly as the winding tube is radially collapsing without having the ends of the composite block each other's radially inward movement.

10. An apparatus as claimed in claim 1 wherein the winding tube is dimensionally stable with a thermal expansion of 0.000015 inches/inch/degree Fahrenheit or less.

11. An apparatus as claimed in claim 1 wherein the winding tube is generally cylindrical and has a diameter of from six to fourteen inches.

12. An apparatus as claimed in claim 1 wherein the winding tube is generally cylindrical and has a diameter of from eight to twelve inches.

13. An apparatus as claimed in claim 1 wherein the sheets of the composite are made with long fiber technology in which the filaments are selected from the group consisting of fiberglass, Kevlar man-made fibers for generalized use in the industrial arts, Nomex man-made fibers for general use in the industrial arts, and for various military applications, carbon fiber, and Spectra polyethylene fiber.

14. An apparatus as claimed in claim 1 wherein the filaments of one sheet are oriented at 90 degrees with the filaments of the other sheet.

15. An apparatus as claimed in claim 1 wherein the filaments are fiberglass.

16. An apparatus as claimed in claim 1 wherein the composite has a memory of being flat and the outer covering fabric is flexible and the composite and outer covering fabric cooperate to form a cylindrical shape that is held open by the resilience of the composite seeking to restore its flat shape, constrained by the outer fabric.

17. An apparatus as claimed in claim 1 wherein the outer covering is a sleeve of a thermoplastic film.

18. A winding tube for glass fiber yarn comprising an inner cylinder and an outer covering on the inner cylinder, the inner cylinder being made of a composite having at least two sheets of polypropylene film bonded together, with each sheet having a plurality of parallel fiberglass filaments embedded within the film of that sheet, and with the filaments of one sheet being at 90 degrees with the filaments of the other sheet, the outer covering being a polyester fabric having a spiral stitching of thread, so glass fiber yarn can be wound on the fabric covering of the winding tube to make a yarn package, the winding tube having sufficient resilience to maintain a cylindrical shape and sufficient flexibility that after a desired amount of glass fiber yarn is wound on the winding tube to make a yarn package, the winding tube can be radially collapsed sufficiently to permit the winding tube to be withdrawn from within the yarn package, wherein the winding tube is dimensionally stable in length and width with a thermal expansion of 0.000015 inches/inch/degree Fahrenheit or less.

* * * * *